United States Patent [19]

Weber et al.

[11] 4,379,692

[45] Apr. 12, 1983

[54] METHOD OF DRYING AND PREHEATING MOIST FINE MATERIAL AND APPARATUS FOR CARRYING OUT THE METHOD

[75] Inventors: Heinrich Weber, Recklinghausen; Kurt Lorenz, Hattingen; Horst Dungs, Herne, all of Fed. Rep. of Germany

[73] Assignee: Firma Carl Still GmbH & Co. KG, Recklinghausen, Fed. Rep. of Germany

[21] Appl. No.: 289,235

[22] Filed: Aug. 3, 1981

[30] Foreign Application Priority Data

Aug. 2, 1980 [DE] Fed. Rep. of Germany ..... 3029398

[51] Int. Cl.³ ..... F26B 9/12; F26B 3/00; F26B 17/12

[52] U.S. Cl. ..... 432/18; 34/31; 34/39; 34/40; 34/165; 34/177; 432/102

[58] Field of Search ..... 432/18, 95, 102, 215; 34/31, 39, 40, 165, 167, 177, 175

[56] References Cited

U.S. PATENT DOCUMENTS

| | | | |
|---|---|---|---|
| 1,905,883 | 4/1933 | Barstow et al. | 432/102 |
| 1,932,830 | 10/1933 | Puening | 34/167 |
| 2,552,014 | 5/1951 | Puening | 432/18 |
| 3,031,773 | 5/1962 | Dunkle | 34/177 |

*Primary Examiner*—John J. Camby
*Attorney, Agent, or Firm*—McGlew and Tuttle

[57] ABSTRACT

A preheating moist fine material, such as pit coal and lignate, peat, wood, oil shale, or even ores or limestone for cement production, and an apparatus for carrying out the method are disclosed. Moist fine material is mixed above a heater with predried and preheated material until the mixture is made fluid. The fluid mixture slides down between and piles up to a level above the heater. A part of the predried and preheated fine material is removed from below the heater in an amount corresponding to another part thereof and is conveyed to above the heater with the moist fine material.

15 Claims, 3 Drawing Figures

METHOD OF DRYING AND PREHEATING MOIST FINE MATERIAL AND APPARATUS FOR CARRYING OUT THE METHOD

FIELD AND BACKGROUND OF THE INVENTION

The invention relates to a method of drying and preheating moist fine material, such as pit coal and lignite, peat, wood, oil shale, as a preliminary stage to carbonization, or even ores, or limestone for the cement production, in which the fine material is fed to a drier-heater system and moved therein along heating devices and then removed from the drier-heater system. The invention further relates to an apparatus for carrying out the method.

Moist fine material may be dried and preheated either directly by means of hot inert or flue gases, for example, in conventional flash driers, or by means of indirectly heated surfaces or tubes. In the indirect method, it is necessary to obtain a satisfactory heat transfer with an extended surface and space utilization and a minimum layer thickness, without the material which is to be dried, congesting or forming bridges. Several methods have been provided in this regard.

A combined direct and indirect drying and preheating is known from the fluidized bed drying. A hot fluidizing gas is blown in the fine material charge, to improve the heat transfer and obtain a satisfactory fluidity, or to avoid congestions, in addition to the indirect heat transfer through heating coils.

Both in flash drying and the fluidized bed drying, a considerable amount of electric energy must be supplied to circulate the hot gases. In addition, a large dust separating equipment is needed.

The drying and preheating fine coal by means of heating tube nests vibrating at natural frequency in a conveyor trough is also known. Since the natural frequency depends on the size of the tubes, narrow limits are set for drier performance. In addition, the tube material stresses and the electric energy requirements are high.

Finally, so-called rotary drum driers are known which are equipped, in their interior, with heating tube nests as well as with means for feeding and discharging the moist and preheated fine coal. The rotary drive itself provides the transverse and vertical displacement of the charge. To this end, the drum is mounted with a slight inclination and provided with inserts by which the coal fed to, and accumulating at, the bottom of the drum is raised above the heating tube nests arranged at the center of the drum, and dropped on the tube nests. Due to this slight inclination of the rotary drum, the fine coal fed in at one end migrates to the other end where it is removed. During this travel, the coal is repeatedly caused to fall on the tube nests where it dries while sliding down on the tubes freely, without piling up.

To prevent congestions and formation of bridges at the entrance, certain minimum fluidity requirements must be imposed on the charged material.

The operation of such rotary drums having a stationary internal equipment raises particular problems with the gas-tight sealing of the drum relative to the stationary heads in which the tube nests are mounted.

SUMMARY OF THE INVENTION

The invention is directed to a method and apparatus of the above-mentioned kind which permits the feed of moist fine material and its movement through the heating devices without problems, while reducing the electric energy requirements below that usual in the prior art systems, and eliminating any problems of sealing.

For this purpose, the invention provides the operating steps of mixing the moist fine material above the heating means with predried or preheated fine material until the mixture is made fluid, allowing the loose or fluid material to slide down between and pile up to a level above the heating means, removing a part of the predried and preheated fine material below the heating means from the drier and heater system in an amount corresponding to the amount of moist fine material fed in, and conveying another part thereof to above the heating means and mixing at least a part thereof with the moist fine material. This mixing of moist and preheated fine material before its passage to the heating devices makes possible that even material with a higher moisture content and of unsatisfactory or reduced fluidity can move through the narrow passages in the heating devices without clogging them or forming bridges.

It has been found advisable to mix the fed-in moist material and the predried and preheated material in a proportion ranging from 1 to 1 up to 1 to 3 to obtain a satisfactory drying, and a trouble free operation.

Preferably, a mixture of moist and predried and preheated fine material is passed over merely a part of the heating devices, while the other part of the heating devices is charged with predried and preheated fine material. In this way, in one zone of the heating devices, the material is predried to a certain extent at low temperatures and, in the other zone, the material is dried completely and heated to the desired final temperature.

The inventive method further provides that over the entire range of the heating devices, the vapors from material heating be taken off upwardly. Due to this utilization of the entire cross-sectional area above the heating devices, the velocity of the vapors escaping from the dried material remains low and only a small proportion of dust particles is entrained.

To carry out the inventive method, an apparatus is provided of the type having heating means, means for feeding the moist fine material to the heating means and means for removing the preheated fine material below the heating means, means for conveying the preheated fine material transversely and vertically, means defining a vertical drier and a heater compartment housing the heating means, a vertical elevator for recycling the fine material to the heating means mounted laterally of the compartment, a transverse conveyor and means for supplying the vertical elevator mounted below the heating means, mixing means for mixing and distributing the moist and the preheated fine material mounted above the heating means, and a common shell housing all of the aforesaid means, the shell having an upper hood and an exhaust chimney. The arrangement of all the elements within a common shell, through which only the drives penetrate to the outside without sealing problems, makes the apparatus simple in operation and therefore relatively inexpensive.

The heating devices are preferably designed as horizontally extending nests of tubes, with the tubes having an outer diameter of 14 to 70 mm and being spaced from one another horizontally, or horizontally and vertically, by distances of 15 to 50 mm, preferably 20 to 30 mm, depending on the grain size of the material. The individual tubes may or may not be vertically aligned with each other.

It is advantageous for adjusting the temperatures, or for repairs if necessary, to subdivide the nests of tubes into separate partial nests.

It is also advantageous, to separate the drier and heater compartment from the compartment for the elevator by a partition.

The invention further provides a sectioning of the compartment accommodating the heating devices by a vertically extending guide sheet into a drier compartment and a heater compartment. Two zones are thereby obtained, a preheating zone in which a part of the fine material is charged by the elevator from above to the tube nests, and an adjacent overheating zone wherefrom a part of the material is conveyed below the tube nests by the transverse conveyor to the bucket elevator, and another part is removed from the system as a dried and preheated product.

In accordance with the invention, a deflector plate extending obliquely upwardly from the top of the guide sheet between the drier and the heater compartment may be provided, which is adjustable in its inclination and serves the purpose of directing a part of the predried and preheated fine material from the delivery point of the elevator to the heating devices in the heater compartment. The deflector plate is adjustable by means of a linkage passing to the outside and can be used within limits for apportioning the predried material to the drier compartment and the heater compartment.

Experience has shown that it is advantageous to design the transverse conveyor and the feed and discharge mechanisms for the fine material as screw conveyors, and the elevator as a bucket conveyor.

It is particularly economical to use steam, especially saturated steam, for drying and preheating the coal. Consequently, the heating pipes will be designed as steam conveying pressure pipes. In a coking plant, for example, this calls for using the steam produced during the quenching operation.

The vapors are taken off in the inventive arrangement through a hood having an exhaust chimney at the top, with the hood extending over the entire upper cross-sectional area of the heating devices. It has proved particularly suitable to provide the exhaust chimney above the drier compartment, since the greatest part of vapors is produced in this area and they have a lower temperature than over the heater compartment. The vapors may also be separated from each other by providing an exhaust chimney both above the drier compartment and the heater compartment. It may be advantageous for the condensation and further use of the removed vapors, to have a humid portion with a somewhat lower temperature, and a drier and hotter portion.

Within the hood, baffle plates may be provided, below the exhaust chimney, to separate dust.

It is a particular advantage of the inventive design over the prior art, that narrow and high nests of tubes may be provided which, among other things, simplifies the distribution of the fine material over the tube nests.

Accordingly, it is an object of the invention to provide an improved method of drying and preheating moist fine material and an apparatus for carrying out the method which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION

Figure 1:
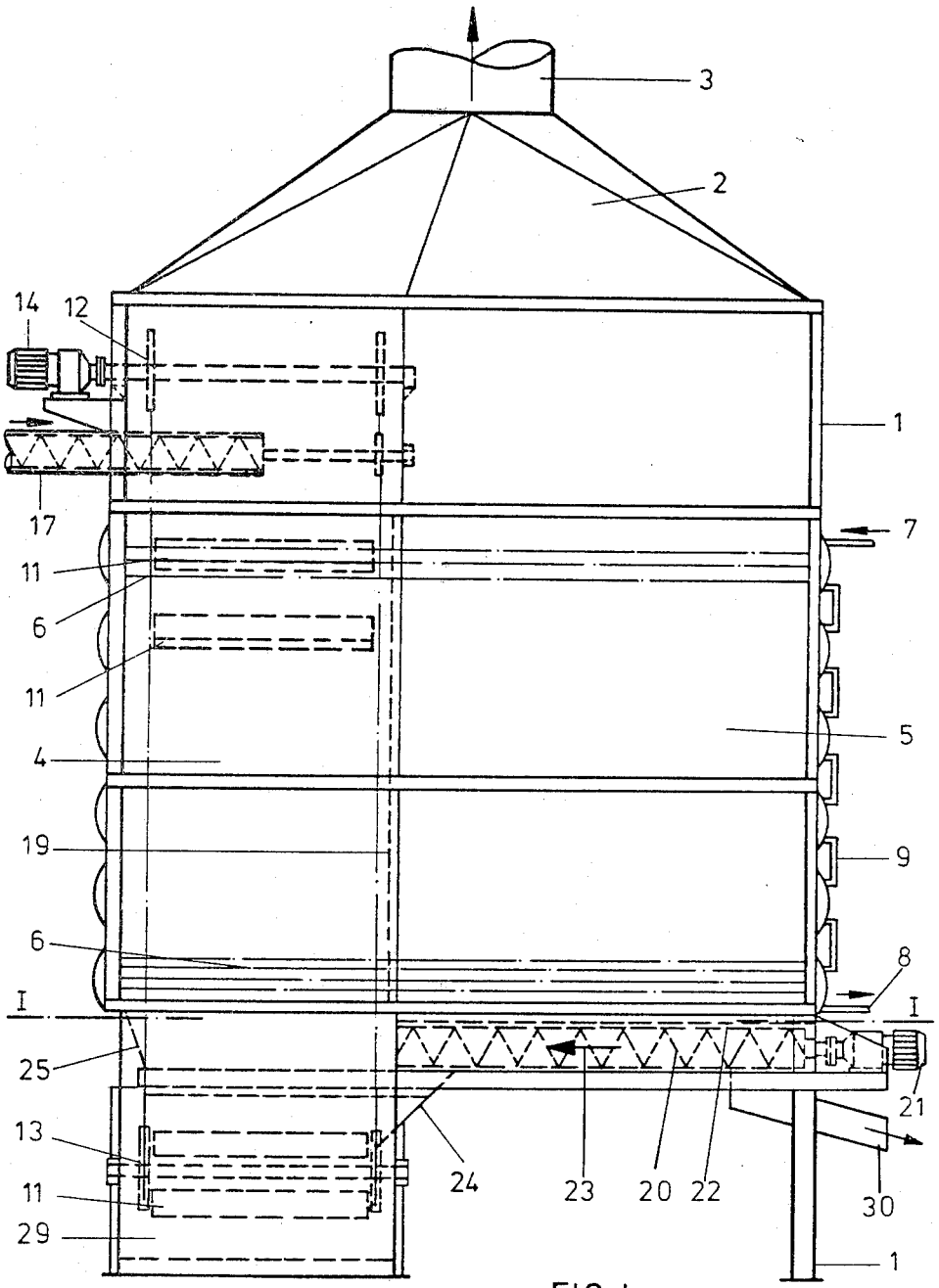
FIG. 1 is a schematic side view of the broad side of the inventive apparatus.
Figure 2:
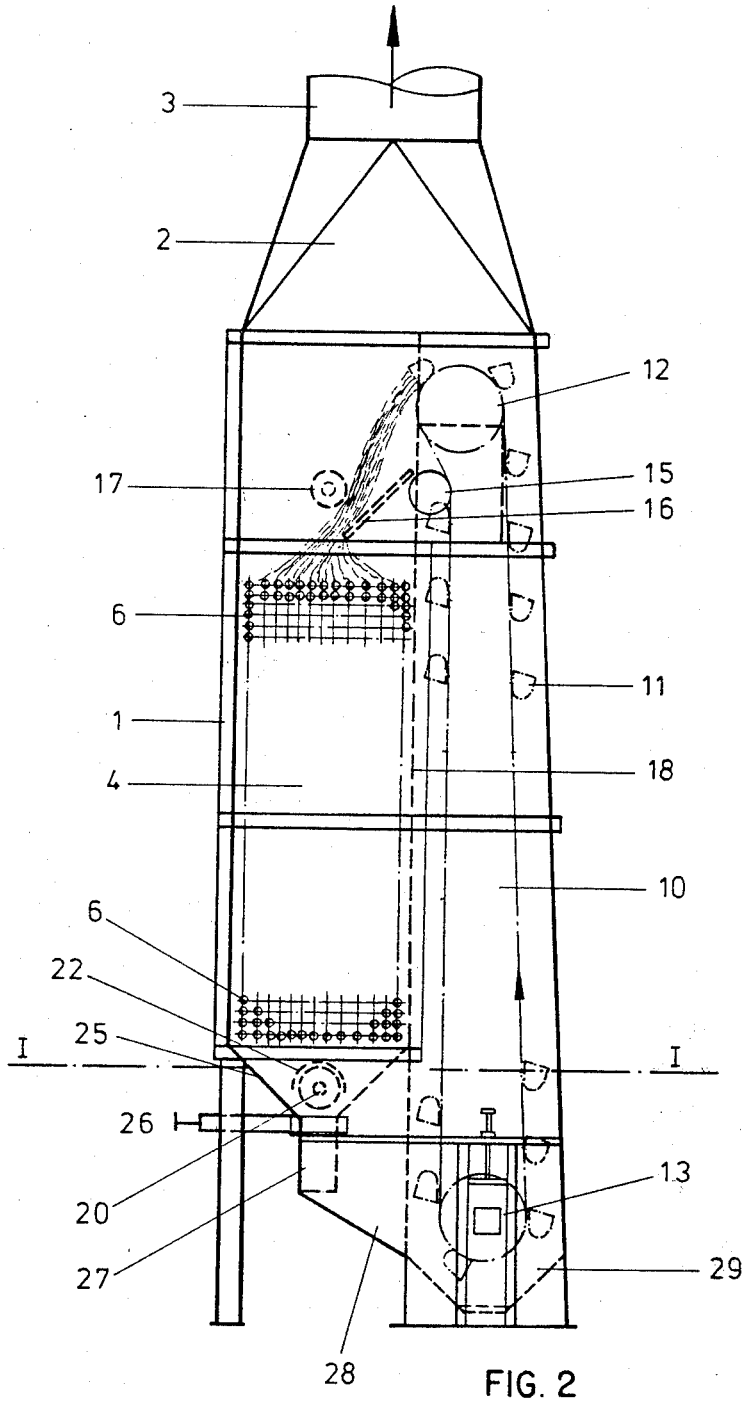
FIG. 2 is an elevation of the apparatus.
Figure 3:
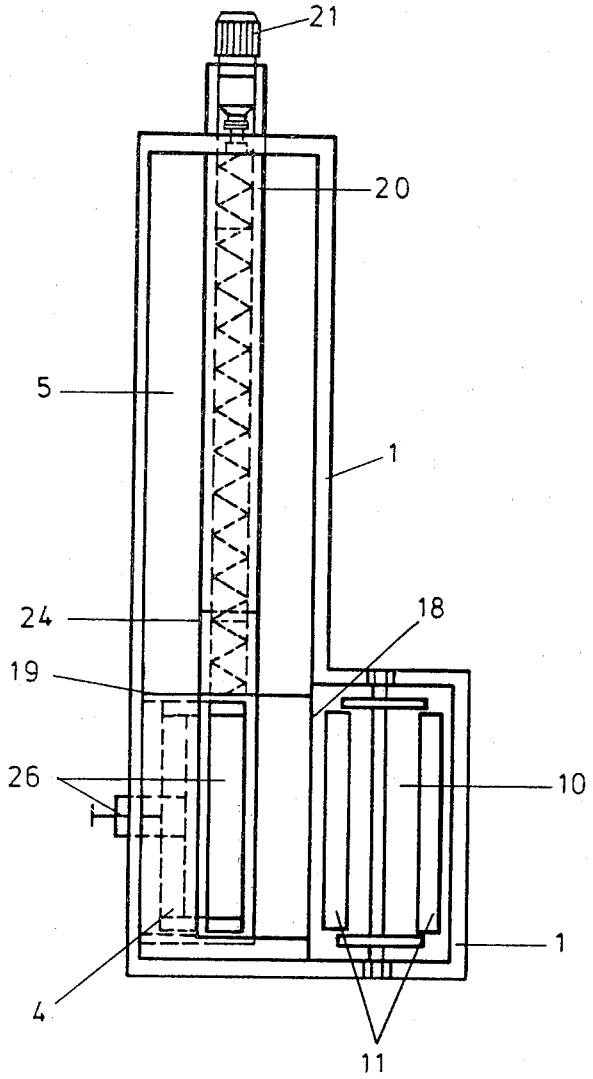
FIG. 3 is a sectional view through the lower part of the apparatus.

The figures show a shell 1 including the respective supporting structure and having a hood 2 and an exhaust chimney 3. In addition, a drier compartment 4 and a heater compartment 5, accommodating horizontally extending nests of steam tubes 6, a steam supply line 7, a condensate discharge line 8, connecting lines 9, a bucket elevator 10 with buckets 11 and upper and lower return wheels 12, 13 and a drive 14 are illustrated. At a guide roller 15, a deflector plate 16 is provided for directing the coal conveyed by the elevator to the uppermost tube nest 6. A screw conveyor 17 for feeding moist coal extends about to the middle of drier compartment 4. A partition 18 is provided between drier compartment 4 and the bucket elevator 10, and a guide sheet 19 extends vertically between the drier and heater compartments. The top of guide sheet 19 is about flush with the upper edge of tube nests 6 and the individual steam tubes of the nest are passed through the sheet. Below tube nests 6, a transverse conveyor 20 is provided which is designed, in the present example, as a horizontal screw conveyor. As all of the drives, the drive 21 of conveyor 20 is mounted outside the shell and has only its output shaft sealed relative to the shell.

In operation, the moist material to be dried, for example, fine coal, is fed by screw conveyor 17 into a closed and slightly pressurized drier and heater space where, above about the middle zone of the tube nests of the drier compartment 4, it is brought into contact with a stream of already dried and preheated coal and, by means of a mixing rake (not shown), mixed therewith and at the same time uniformly distributed over the area of the tube nest in the zone of drier compartment 4. This causes an intense water evaporation whereby the fine coal bed above the tube nest is considerably loosened up and already assumes properties of a fluid. An approximate height of 0.3 meters of the coal bed above the heating tubes is kept constant by means of an isotope-controlled slide gate 26 provided beneath the tube nest in the zone of drier compartment 4. By means of gate 26, the desired predried fine coal stream flowing through a funnel 25, outlet 27, and chute 28 into the sump 29 of the bucket elevator, can be adjusted. The screw conveyor 20 extending beneath tube nest 6 in the zone of heater compartment 5 conveys the preheated coal in the direction of arrow 23 back to chute 24 leading to the sump 29 of elevator 10. In the sump, the preheated coal is scooped by buckets 11 of the elevator, carried upwardly and discharged at the top of the elevator onto deflector plate 16 wherefrom it is distributed over the uppermost tube nest. To release the pressure of the charge on screw conveyor 20 and obtain a regular filling degree of the screw, the conveyor is covered with a semicylindrical plate 22. The outlet 30 for the dry, preheated material, is provided at the bottom of heater compartment 5 at a location diagonally opposite to the inlet where the moist coal is fed into drier compartment 4. At outlet 30, an amount of the heated coal is removed exactly corresponding to the amount of moist coal fed in.

The vapors produced during the drying and preheating operation accumulate in hood 2, above the drier and heater compartments, and are directed through exhaust chimney 3 for condensation (not shown) in a known arrangement.

EXAMPLE

To dry 80t/h of fine coal having a moisture content of 10% and a grain size throughout smaller than 5 mm, and preheat it to about 220° C., a tube nest is needed having a width of 1.5 meters, height of 4 meters, and length of 7 meters. The individual tubes of the nest are supplied with saturated steam under a pressure of 40 bar. The tubes have an outer diameter of 38 mm and are spaced apart by 25 mm.

The fine coal is carried upwardly through a height of 8 meters by a bucket elevator having a performance of about 240 metric t/h. The width of the elevator is 2 meters. Of the roughly 240 metric t/h transported upwardly about 80 metric t/h are directed into the drier compartment, and 160 metric t/h into the heater compartment, with a mixing ratio of 1 to 1 of moist to predried and preheated fine material. The transverse conveyance of the preheated fine coal in the lower part of the heater compartment is effected with a screw conveyor having a diameter of 650 mm and a length of 3.5 meters, and covered above through about 180° C. About 70 metric t/h of dried and preheated coal are removed from the system.

Thus, in accordance with the invention, there is provided a method of drying and preheating fine material, such as bituminous and sub-bituminous coal, peat, wood, oil shale, or also ores or limestone, in which the moist material is fed to a drier-heater system and moved therein along heating devices and then removed from the drier-heater system, characterized by the steps of mixing the fed-in moist fine material above the heating devices, with already predried or preheated fine material until the mixture is made fluid, allowing the loose mixture to slide down between, and pile up to a level above the heating devices, removing a part of the predried and preheated fine material below the heating devices from the drier-heater system in an amount corresponding to the amount of moist fine material fed in, and conveying another part thereof above the heating devices again and mixing it entirely or partly with the moist fine material. The method is preferably characterized by a mixing ratio of the moist fine material to be fed into the predried and preheated fine material ranging between 1 to 1 and 1 to 3. The step of mixing moist and predried fine material preferably takes placed only above a part of the heating devices and that another part of the heating devices iinteracts only with predried and preheated fine material. The vapors from the fine material drying are exhausted upwardly over the entire range of the heating devices.

An apparatus for carrying out the method according to the invention include heating devices, mechanisms for feeding the moist fine material to the heating devices and removing the preheated fine material below the heating devices, and for conveying the preheated fine material transversely and vertically, characterized in that the heating devices 6 are accommodated in a vertical drier and heater compartment 4,5 and that a vertical elevator 10 for recycling the fine material to the heating devices 6 is mounted laterally of the compartment, and a transverse conveyor 20 and means 24–29 for supplying the elevator 10 are provided below the heating device 6, and a mixing device for mixing and distributing the moist and the preheated fine material is provided above the heating devices, and that all these means and devices are accommodated in a common shell 1, having an upper hood 2 and an exhaust chimney 3.

The heating devices 6 are designed as horizontally extending nests of tubes and that the tubes of the nests have an outer diameter of 14 to 70 mm and are spaced apart horizontally, or horizontally and vertically, by 15 to 50 mm, preferably 20 to 30 mm, depending on the grain size of the fine material. The drier and heater compartment 4,5 and the compartment of the elevator 10 are separated from each other by a partition 18.

The compartment accommodating the heating devices 6 is subdivided by a guide sheet 19 into a drier compartment 4 and a heater compartment 5.

A deflector plate is provided adjacent the top of the guide sheet whose inclination is adjustable and which serves the purpose of directing a part of the predried and preheated fine material from the delivery of the elevator 10 to the heating devices in the heater compartment 5. The transverse conveyor 20 and the feed and discharge mechanism 17, 30 for the fine material are designed as screw conveyors and that the elevator is designed as a bucket conveyor 10. The heating tubes of the nests 6 are preferably designed as steam conducting pressure pipes.

The exhaust chimney 3 for the drier vapors is provided above the drier compartment. An exhaust chimney is provided above both the drier compartment 4 and the heater compartment 5. The baffle plates for separating dust are provided in the hood 2, below the exhaust chimney 3.

While a specific embodiment of the invention has been shown and described in detail to illustrate the application of the principles of the invention, it will be understood that the invention may be embodied otherwise without departing from such principles.

What is claimed is:

1. A method of drying and preheating moist fine material, in particular bituminous and soft bituminous coal, peat, wood, oil shale, ores or lime stone, in a system having a single open drier chamber with heating means having heating surfaces extending into the drier chamber for indirect heating of the fine material, fine material supplied to a top of the drier chamber being able to fall upon and past the heating surfaces from the top of the drier chamber to a bottom of the drier chamber, the method comprising:

continuously feeding a first amount of moist fine material to the top of the drier chamber above the heating means;

conveying a second amount of predried fine material from the bottom of the drier chamber to the top of the drier chamber;

mixing the second amount of predried fine material with the first amount of moist material at the top of the drier chamber and above the heating means to make a mixture of predried and moist fine material which is fluid;

allowing the fluid mixture to slide down the drier chamber onto and between the heating surfaces and to pile up to a level in the drier chamber above the heating means; and removing a third amount of predried fine material from a bottom of the drier chamber below the heating means, the third amount equaling the first amount of moist fine material being fed to the top of the drier chamber.

2. The method according to claim 1, wherein the mixing ratio of the moist fine material to be mixed with the predried fine material ranges between 1 to 1 and 1 to 3.

3. A method according to claim 1, wherein the system includes a heater chamber adjacent the drier chamber and through which the heating surfaces of the heating means also pass, the method including allowing the fluid mixture of predried and moist fine material to fall only to the top of the drier chamber and conveying a portion of the predried fine material from the bottom of the drier chamber to the top of the heater chamber.

4. The method according to claim 3 further comprising the step of exhausting vapors from drying of the fine material upwardly over an entire range of the heating means.

5. A method according to claim 4, wherein the system includes elevator means extending on one side of the drier chamber and along the height thereof with a sump below the heating means, the elevator being operable for conveying the predried fine material from the bottom to the top of the drier and heater chambers, the method including conveying predried and preheated fine material from a bottom of the heater chamber to the sump of the elevator and removing the third amount of predried fine material from the bottom of the heater chamber.

6. An apparatus for predrying and preheating moist fine material, such as bituminous and soft-bituminous coal, peat, wood, oil shale, ores or limestore, comprising:

means defining a vertically extending open drier chamber and a vertically extending open heater chamber adjacent said drier chamber;

heating means extending through said drier and heater chambers having heating surfaces onto and past which fine material can fall for indirect heating thereof;

means for heating moist fine material to a top of said drier chamber above said heating means;

means for removing preheated fine material from a bottom of said heater chamber below said heating means;

a vertical elevator extending along and adjacent said drier chamber for conveying fine material from a bottom of said drier chamber below said heating means to a top of said drier chamber above said heating means;

a transverse conveyor mounted below said heating means in said heater chamber for conveying fine material from a bottom of said heater chamber to a lower end of said elevator;

mixing means for mixing and distributing moist and pre-dried fine material above said heating means to the top of said drier chamber; and a hood with exhaust chimney connected at a top of said means defining said drier and heater chambers for exhausting vapors from the top of said heater and drier chambers.

7. The apparatus according to claim 6, wherein said heating means comprise horizontally extending nests of tubes, said tubes of the nest having an outer diameter of 14 to 70 mm and being spaced apart at least horizontally by 15 to 50 mm.

8. The apparatus according to claim 7, wherein said tubes are spaced apart horizontally and vertically 20 to 30 mm.

9. The apparatus according to claim 7, further comprising a partition separating said drier and heater chambers from an elevator compartment for said elevator.

10. The apparatus according to claim 9, further comprising a guide sheet subdividing said drier and heater chambers into said drier and a heater chambers.

11. The apparatus according to claim 10, further comprising a deflector plate mounted adjacent the top of said guide sheet, said deflector having an adjustable inclination directing a part of the predried and preheated fine material from a delivery point of said elevator to said heating means in said heater chambers.

12. The apparatus according to claim 10, wherein said transverse conveyor, said feeding means, and said removal means for the fine material are screw conveyors and said elevator is a bucket conveyor.

13. The apparatus according to claim 7, wherein said heating tubes of the nests are steam conducting pressure pipes.

14. The apparatus according to claim 10, wherein said exhaust chimney is mounted above said drier chamber.

15. The apparatus according to claim 14, wherein said chimney comprises a first exhaust connected to said drier chamber and a second exhaust connected to said heater chamber.

* * * * *